US005219089A

United States Patent [19]

Kiolbasa et al.

[11] Patent Number: 5,219,089

[45] Date of Patent: Jun. 15, 1993

[54] NON-CORRUGATED CARDBOARD BOX CONSTRUCTION

[75] Inventors: Charles G. Kiolbasa, LaGrange; John Christiansen, Algonquin, both of Ill.

[73] Assignee: Chapco Carton Company, River Grove, Ill.

[21] Appl. No.: 849,891

[22] Filed: Mar. 12, 1992

[51] Int. Cl.[5] ..... B65D 5/54; B65D 5/56

[52] U.S. Cl. ..... 220/416; 220/441; 229/225

[58] Field of Search ..... 229/225, 235; 220/416, 220/418, 441, 443

[56] References Cited

U.S. PATENT DOCUMENTS

| | | | |
|---|---|---|---|
| 2,349,605 | 5/1944 | Becker | 220/416 |
| 2,783,692 | 3/1957 | Bolding | 220/416 |
| 3,145,903 | 8/1964 | Franklin, Jr. | 220/416 |
| 3,217,960 | 11/1965 | Davis | 220/416 |
| 3,708,108 | 1/1973 | Rosenburg, Jr. | 229/225 |
| 4,986,420 | 1/1991 | Gunn et al. | 229/225 |

FOREIGN PATENT DOCUMENTS

| | | | |
|---|---|---|---|
| 439078 | 12/1967 | Switzerland | 229/225 |
| 1456419 | 11/1976 | United Kingdom | 220/416 |

*Primary Examiner*—Gary E. Elkins
*Attorney, Agent, or Firm*—Allegretti & Witcoff, Ltd.

[57] ABSTRACT

A non-corrugated box cardboard construction. The box has exterior panels, top and bottom flaps, and interior pads. An interior panel lies interior to and immediately adjacent each exterior panel, whereby the interior panels reinforce and support the exterior panels. The exterior panels, interior panels and flaps are joined by continuity to each other, having been cut from a single sheet. The fold lines between the interior panels include perforation lines along the fold lines.

2 Claims, 4 Drawing Sheets

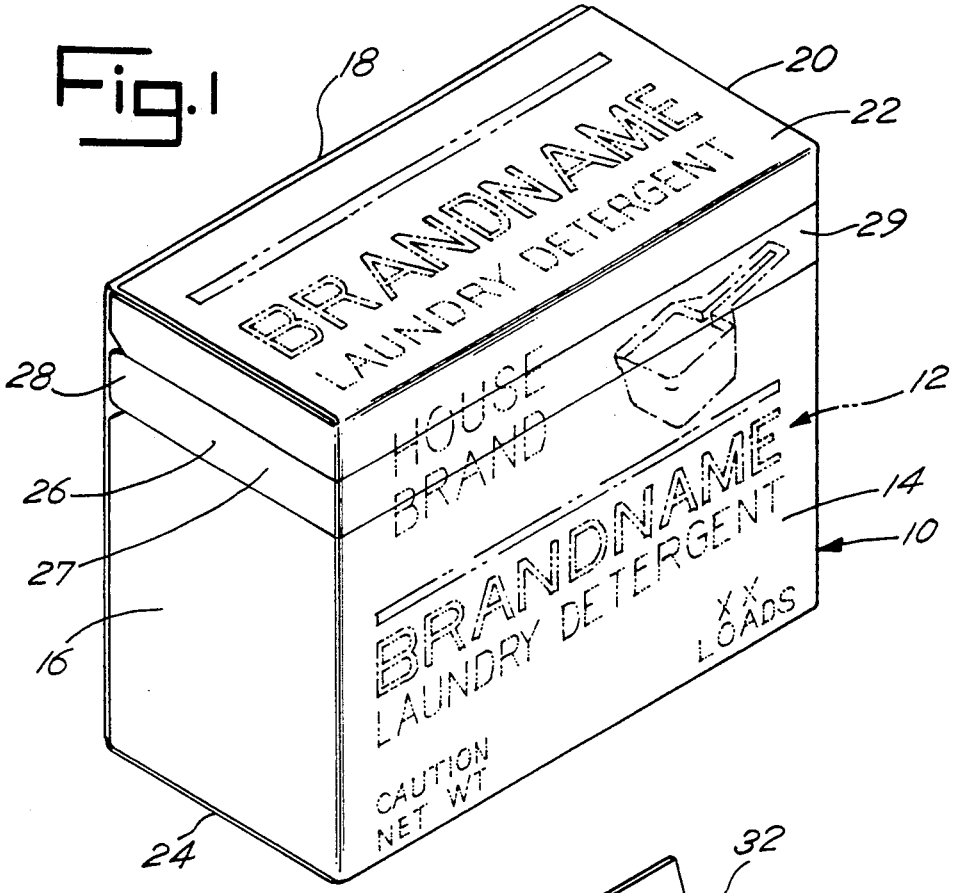
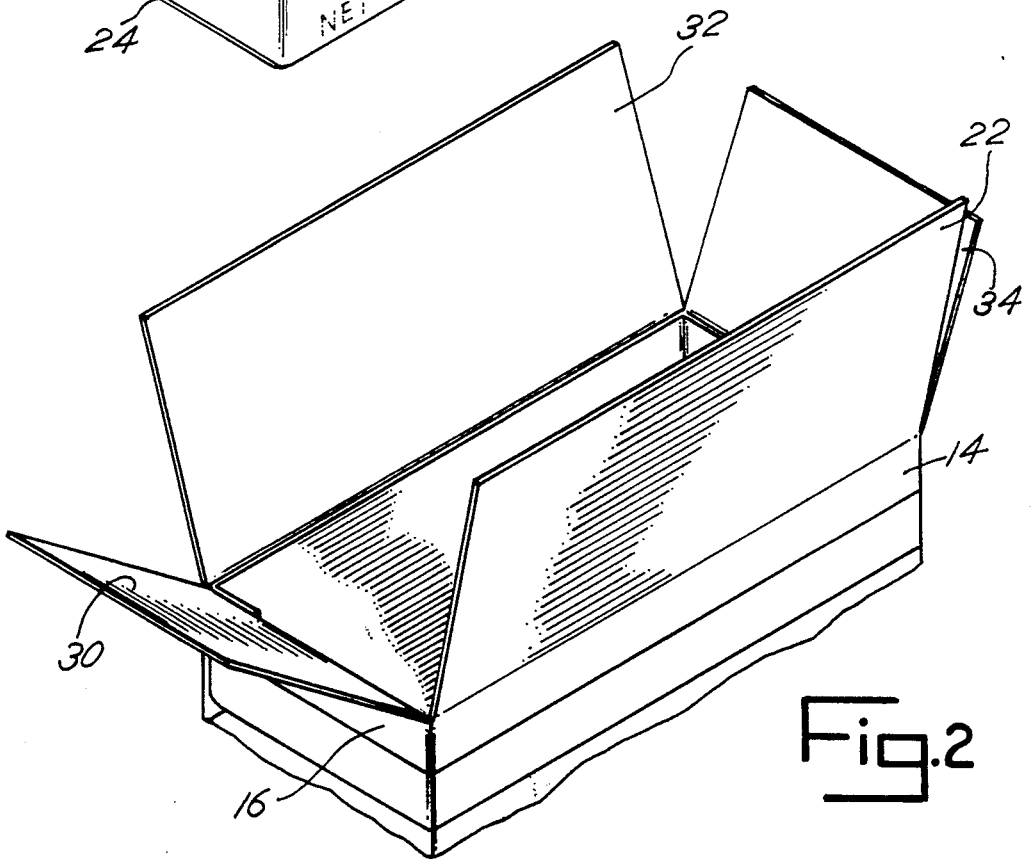
Fig.2

NON-CORRUGATED CARDBOARD BOX CONSTRUCTION

BACKGROUND AND SUMMARY OF THE INVENTION

This invention relates to packaging, and more specifically to construction of non-corrugated cardboard boxes.

Corrugated and non-corrugated cardboard boxes have long been made. A conventional rectangular such box has four side panels and a side-panel-joining flap, and end flaps with each side panel. It has been found that with certain applications, including such dense materials as granular laundry detergents, four panel non-corrugated boxes are subject to damage and breakage during handling.

A primary object of the invention which is the subject of this specification is substantially complete elimination of damage and breakage of non-corrugated boxes filled with dense materials such as granular laundry detergents.

Another primary object of the invention of this specification is continued utilization of non-corrugated cardboard for applications such as granular laundry detergent, including non-corrugated cardboard of 24 point thickness.

In a primary aspect, this invention comprises a non-corrugated cardboard box construction including inner side panels and outer side panels, all formed of a singe sheet of cardboard. The outer side panels wrap the inner side panels, for doubled side panels in the completed box.

In other primary aspects, this invention comprises a non-corrugated cardboard box construction of doubled side panels with specific construction details of fold lines, perforation lines, glue lines and side and end panel relationship to each other, all of which combine to achieve a highly superior construction.

These and other objects, aspects and advantages of the invention will be best understood by a complete reading of a detailed description of the preferred form of the invention, which follows, after a brief description of the accompanying drawing.

BRIEF DESCRIPTION OF THE DRAWINGS

The accompanying drawings comprises six figures, FIGS. 1, 2, 3, 4A, 4B, and 4C. A brief description of each figure is as follows.

FIG. 1 is a perspective view of the preferred box construction the invention, after contents such as granular laundry soap is filled into the box and final assembly is completed.

FIG. 2 is a partial perspective view of the top of the box of FIG. 1, illustrating its top flaps, and because they are identical, its bottom flaps.

DETAILED DESCRIPTION OF THE PREFERRED FORM OF THE INVENTED BOX CONSTRUCTION

Figure 3:
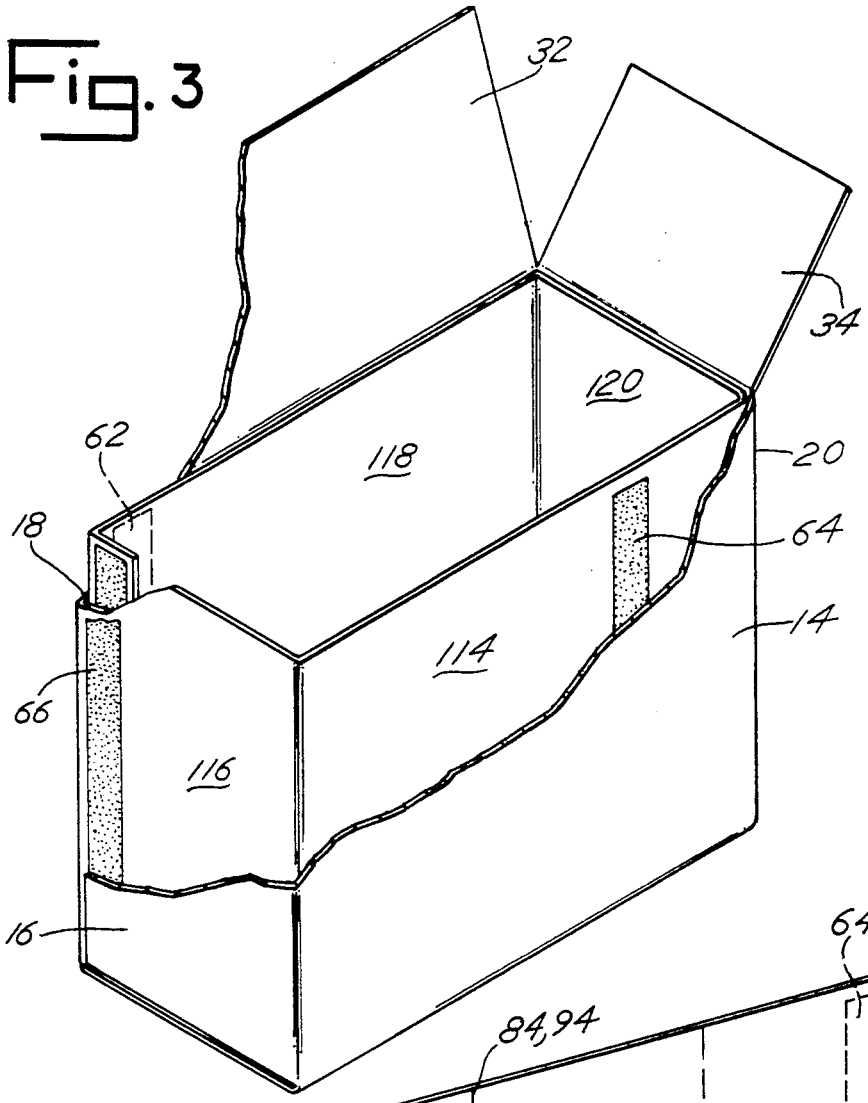
FIG. 3 is a perspective view of the box of FIG. 1, with portions of the box torn away to reveal internal construction.

Referring to FIG. 1, the preferred form of the invented box construction is generally designated 10. Box 10 is rectangular, and formed of non-corrugated cardboard having a thickness of twenty-four thousandths of an inch, knows as "24 point" non-corrugated cardboard.

As shown, the box 10 is suitable for having advertising copy such as copy 12 printed on the exterior of the box, on all such panels and flaps as desired. As conventional, when viewed from the exterior by a consumer, the box 10 has four exterior or outer side panels 14, 16, 18 (not visible in FIG. 1), 20 (also not visible in FIG. 1), an exterior top flap 22, and an exterior bottom flap 24 (edge only visible in FIG. 1). The box 10 includes a tear strip 26 with a pull tab 28, with the tear strip 26 extending in segments 27, 29, 31 horizontally across the side panels 16, 14, 20, for convenient opening of the box 10. (The box top folds back along a horizontal perforation and fold line 33 across side panel 18.) As shown in FIG 2, the top of box 10 includes four top flaps, exterior top flap 22, and the top flaps 30, 32, 34. As conventional, in final assembly, the flaps 30, 34, underlie the flaps 32, 22, and flap 32 underlies the flap 22. The bottom box 10 is a duplicate of the top, with (see FIGS. 4A, 4B and 4C) bottom flaps 24, 50, 52, 54. Thus, the box 10 has the advantages of appearance and exterior construction which are familiar to the consumer.

Figure 4A:
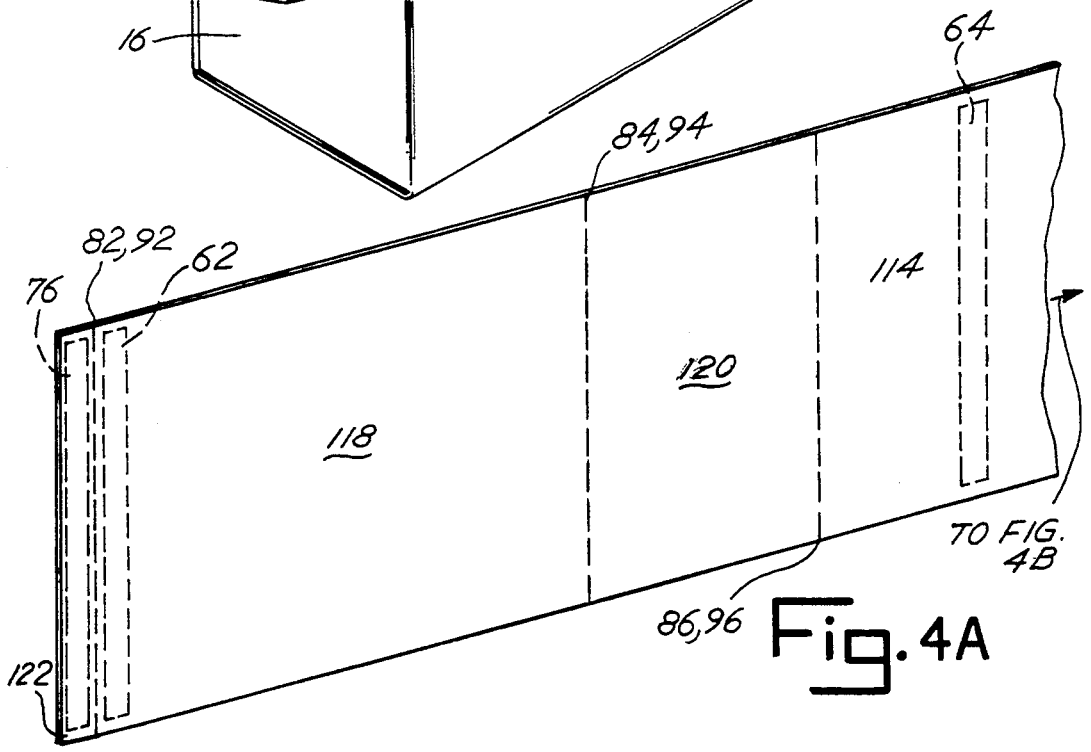
FIG. 4A is a perspective view of the "blank" from which the box of FIG. 1 is constructed, illustrating the manner in which each panel and flap of the box, including side panels, top flaps and bottom flaps are connected to each other.
Figure 4B:
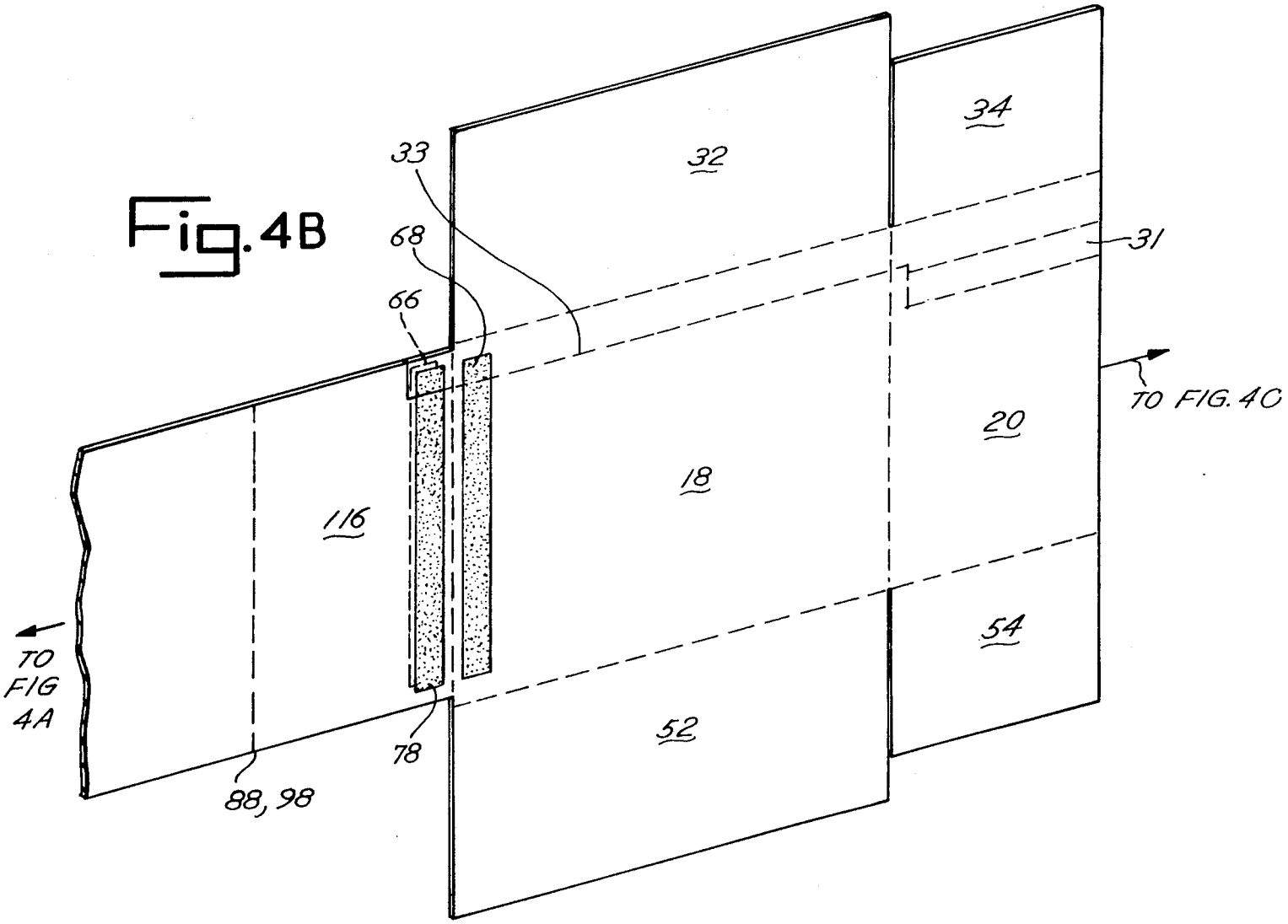
FIG. 4B continues FIG. 4A from the right edge of FIG. 4A, and FIG. 4C continues 4B from the right edge of FIG. 4B.
Figure 4C:
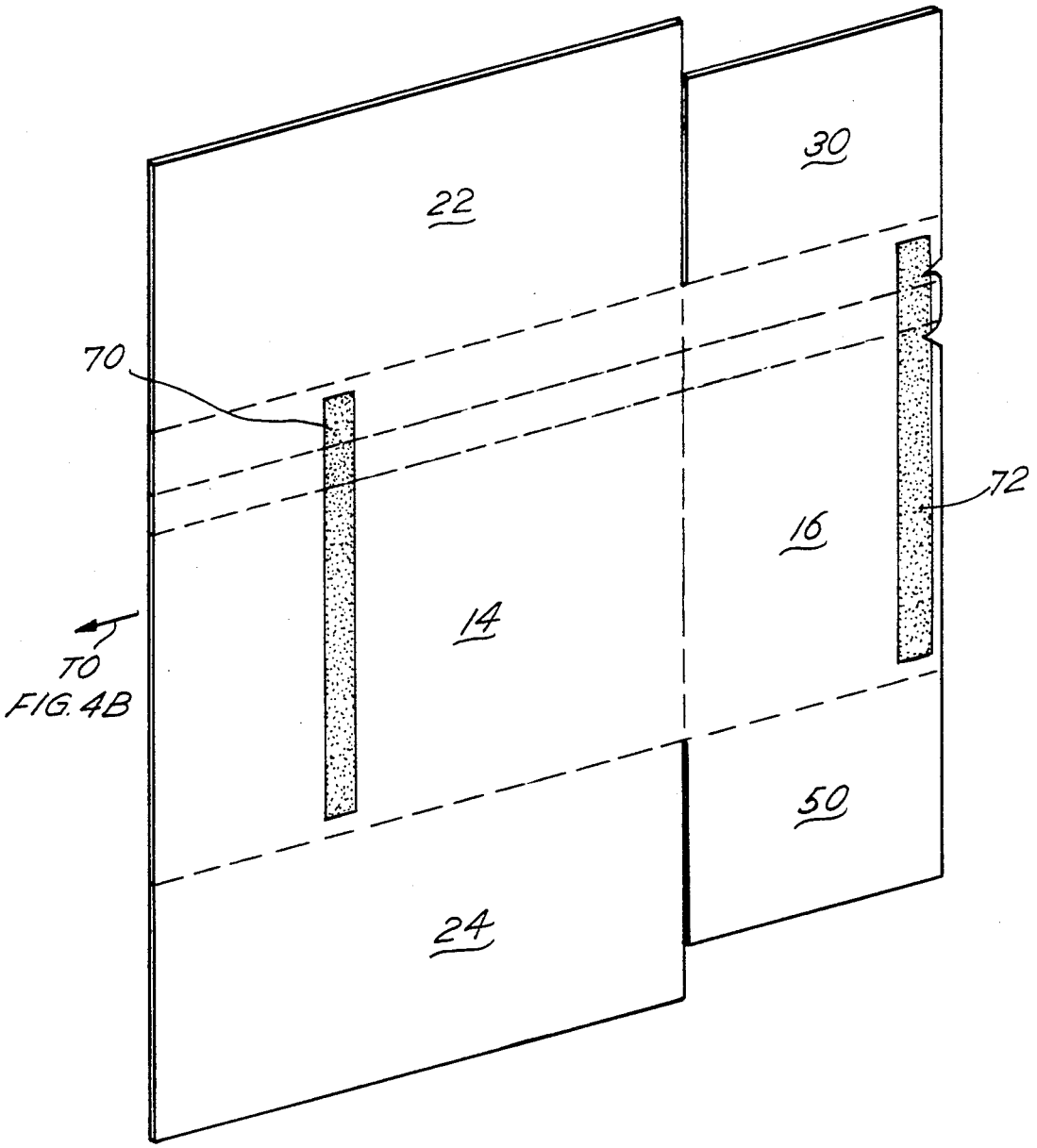

Referring to FIG. 3, in contrast, the box 10 has an unconventional internal construction. As shown in FIG. 3, each outer side panel 14, 16, 18, 20 is reinforced and supported by an inner side panel, respectively 114, 116, 118, 120. Generally, the inner side panels 114–120 are not fastened to the outer side panels 14–20, leaving the inner side panels generally loose within the outer panels. Three beads of adhesive such as glue do join the inner side panels to the outer side panels, and these beads of adjective are formed in adhesive areas 62 (shown in phantom in FIGS. 3 and 4A), 64 (shown in phantom in FIG. 4A), and 66 (shown in phantom in FIG 4B). Adhesive on adhesive areas 62, 64, 66 join the adhesive areas 62, 64, 66 with mating adhesive areas 68, 70, 72, respectively, which mating areas are shown in FIGS. 4B and 4C. Adhesive area 62 is formed on the outer side of inner panel 18, along a side edge thereof, and joins inner panel 118 with outer panel 18. Adhesive area 64 is formed on the outer surface of inner panel 114, approximately 31% of the length of inner panel 114 from the edge of inner panel 114 adjacent inner panel 120, and joins inner panel 114 to outer panel 14. Adhesive area 66 is formed on the outer surface of inner panel 116 along an edge thereof, and joins inner panel 116 to outer panel 16. Inner and outer panels 120, 20 are not adhered or otherwise affixed to each other, and there are no mechanisms of affixing inner an outer panels except as described.

None of the inner side panels 114–120 include a top or bottom flap, which leaves the top and bottom flaps of the outer side panels 14–20 as the only top and bottom flaps of the box 10.

Each inner side panel 114–120 has dimensions reduced from the dimensions of the corresponding outer panel 14–20. As an example, panel 114 has a length shorter that the length of panel 14, such that panel 114 fits snugly against panel 14 and snuggle between panel 16 at one end and panel 20 at the other end. Panel 114 has a height shorter than the height of panel 14, such that panel 114 remains clear of the closure of both to and bottom flaps of the box 10.

All the panels and flaps of the box 10 are formed of a singe sheet of cardboard stock. Referring to FIGS. 4A, 4B and 4C all panels and flaps of the box 10 are cut from a single sheet, as shown. Thus, each panel and flap is "joined by continuity" to each other panel and flap, at least indirectly, through the connection of all panels and flaps to their common whole. Panels and flaps which are immediately adjacent to each other, without other panels or flaps interposed between them, are "joined directly by continuity." Fold lines are at the boundaries between all panels and flaps, and define the boundaries between each panel and flap.

Perforation lines exist along selected fold lines. Perforation lines 82, 84, 86, 88 exist along fold lines 92, 94, 96, 98, respectively. These perforation lines and fold lines are defined along boundaries between the inner side panels 114, 116, 118, 120 with each other and with a side-panel-joining flap 122. The perforations of the perforation lines 82–88 are approximately one-quarter inch long, with approximately one-quarter inch spaces separating the perforations. The perforations facilitate folding along the fold lines.

Mating adhesive areas 76, 78 affix the side-panel-joining flap 122 to the inner side panel 116, along the side edge thereof away from the fold line 88.

The preferred box 10 is now described, and the invention is described in such full, clear, concise and exact terms as to enable a person of ordinary skill to make and use the same. To particularly point out and distantly claim the subject matter regarded as invention, the following claims complete this specification.

What is claimed is:

1. A non-corrugated cardboard box having at least four exterior panels, plural top and bottom flaps, and at least four interior panels, a first of the four interior panels lying interior to and immediately adjacent a first of the four exterior panels, a second of the four interior panels lying interior to and immediately adjacent a second of the four exterior panels, a third of the four interior panels lying interior to and immediately adjacent a third of the four exterior panels, and a fourth of the four interior panels lying interior to and immediately adjacent a fourth of the four exterior panels, whereby the interior panels reinforce and support the exterior panes, the exterior panels, interior panels and flaps being joined by continuity to each other.

the interior panels and exterior panels having mechanisms of affixing the interior panels and exterior panels to each other only in that three adhesive beads join the interior panels and exterior panels to each other, a first of the adhesive beads joining a first-adhered panel of the interior panels to a first-adhered panel of the exterior panels, a second of the adhesive beads joining a second-adhered panel of the interior panels to a second-adhered panel of the exterior panels, and a third of the adhesive beads joining a third-adhered panel of the interior panels to a third-adhered panel of the exterior panels.

2. A non-corrugated cardboard box having at least four exterior panels, plural top and bottom flaps, and at least four interior panels, a first of the four interior panels lying interior to and immediately adjacent a first of the four exterior panels, a second of the four interior panels lying interior to and immediately adjacent a second of the four exterior panels, a third of the four interior panels lying interior to and immediately adjacent a third of the four exterior panels, and a fourth of the four interior panels lying interior to and immediately adjacent a fourth of the four exterior panels, whereby the interior panels reinforce and support the exterior panels, the exterior panels and flaps being joined by continuity to each other and the interior panels being joined to each other by continuity, the interior panels defining fold lines between the interior panels, and perforation lines being defined along the fold lines between the interior panels, the interior panels and exterior panels having mechanisms of affixing the interior panels and exterior panels to each other only in that three adhesive beads join the interior panels and exterior panels to each other, a first of the adhesive beads joining a first-adhered panel of the interior panels to a first-adhered panel of the exterior panels, a second of the adhesive beads joining a second-adhered panel of the interior panels to a second-adhered panel of the exterior panels, and a third of the adhesive beads joining a third-adhered panel of the interior panels to a third-adhered panel of the exterior panels.

* * * * *